US007163286B2

(12) United States Patent
Shiraiwa et al.

(10) Patent No.: US 7,163,286 B2
(45) Date of Patent: Jan. 16, 2007

(54) RECORDING SHEET CONTAINING PACKAGE

(75) Inventors: Yoshinobu Shiraiwa, Tokyo (JP); Etsuro Suzuki, Kanagawa (JP); Gen Kitamura, Kanagawa (JP); Hisashi Kon, Saitama (JP); Noriyuki Arai, Saitama (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 10/892,087

(22) Filed: Jul. 16, 2004

(65) Prior Publication Data

US 2005/0024466 A1 Feb. 3, 2005

(30) Foreign Application Priority Data

Jul. 31, 2003 (JP) ..... 2003-284000

(51) Int. Cl.
*B65H 1/00* (2006.01)

(52) U.S. Cl. ..... 347/104; 400/692; 271/145

(58) Field of Classification Search ..... 347/104; 400/692; 271/145

See application file for complete search history.

(56) References Cited

U.S. PATENT DOCUMENTS

| | | | | |
|---|---|---|---|---|
| 3,727,823 | A * | 4/1973 | Sullivan | 206/449 |
| 5,165,535 | A * | 11/1992 | Manservigi et al. | 206/245 |
| 6,217,019 | B1 * | 4/2001 | Ishiduka et al. | 271/147 |
| 6,246,466 | B1 * | 6/2001 | Hirano et al. | 355/407 |
| 6,357,739 | B1 * | 3/2002 | Sasaki et al. | 271/145 |
| 6,378,997 | B1 | 4/2002 | Nitta | 347/85 |
| 6,471,345 | B1 | 10/2002 | Yoshino et al. | 347/86 |
| 6,563,525 | B1 | 5/2003 | Suzuki | 347/218 |
| 6,612,564 | B1 * | 9/2003 | Todd | 271/145 |
| 2004/0169327 | A1 * | 9/2004 | Swayze et al. | 271/145 |

FOREIGN PATENT DOCUMENTS

| | | | |
|---|---|---|---|
| CN | 1231970 | A | 10/1999 |
| EP | 0 950 532 | A2 | 10/1999 |
| JP | 2-193833 | | 7/1990 |
| JP | 6-64761 | | 3/1994 |
| JP | 9-132277 | | 5/1997 |
| JP | 11-41550 | | 2/1999 |
| JP | 11-254700 | | 9/1999 |
| JP | 2001-213531 | | 8/2001 |
| JP | 2005092914 | A * | 4/2005 |

* cited by examiner

*Primary Examiner*—Daniel J. Colilla
*Assistant Examiner*—Jill E. Culler
(74) *Attorney, Agent, or Firm*—Fitzpatrick, Cella, Harper & Scinto

(57) ABSTRACT

The invention provides a recording sheet containing package containing a recording sheet to be used in a recording apparatus, achieving convenient handling by the user, being inexpensive, realizable light-weight and compact for easy carrying and easily disposed after the use without giving significant influence to the environment.

The recording sheet containing package is constituted of two components which are a recording apparatus fitting portion 21 to be fitted with a mounting portion of the recording apparatus for enabling simple and satisfactory mounting, and a packaging member covering a circumference of a recording sheet P thereby preventing the recording sheet from smear or manual contact.

20 Claims, 9 Drawing Sheets

RECORDING SHEET CONTAINING PACKAGE

This application claims priority from Japanese Patent Application No. 2003-284000 filed Jul. 31, 2003, which is hereby incorporated by reference.

BACKGROUND OF THE INVENTION

1. Field of the Invention

The present invention relates to a recording sheet containing package, containing a recording sheet for use in a recording apparatus, more specifically a printing apparatus for printing an image, taken as an electronic information by a still camera for obtaining a still image or a video camera and fetched through a computer or directly from a recording medium.

2. Related Background Art

An ink jet printer, for forming a record by discharging an ink droplet and depositing it on a recording medium, is already known as an apparatus capable of a high definition image recording close to a photographic quality based on image information obtained by an image pickup equipment. On the other hand, equipment for obtaining image information usable in the printing apparatus, such as a digital camera, a digital video camera or a scanner, has shown a significant progress in recent years. Therefore, a printing apparatus of thermal transfer type is also attracting attention. In such printing apparatus of thermal transfer type, there is known a printer of a line thermal transfer type which utilizes a thermo-sensitive paper for the printing paper and in which plural heat generating elements arrayed in a main scanning direction, crossing a sub scanning direction, are selectively driven to form a print by a dot line in succession, while such paper is conveyed in the sub scanning direction.

The printer of such thermal transfer type is attracting attention as an output apparatus for an image taken by an image pickup device for the following reason. In the ink jet printer, a pixel is usually formed in a binary manner by whether a liquid droplet is discharged or not, so that improvements in the apparent resolution and the gradation are achieved by depositing small liquid droplets on the paper and utilizing the error diffusion method or the like, while the printer of thermal transfer type can relatively easily obtain a larger number of gradation levels within a pixel by controlling the heat generation in plural levels in forming a pixel, whereby a smoother image of higher quality in comparison with the case of ink jet printer can be easily realized. Also since the performances of the thermal head and the sheet material are showing progress as if matching the recent progress in digital cameras, it is now made possible to obtain a print image comparable to a silver halide-based photograph in quality, so that the printer of thermal transfer type is attracting attention as a printer particularly for a natural image.

Therefore, there is commercialized a system in which such printing apparatus and an image pickup device such as a digital camera or a digital video camera are directly connected or are integrally constructed and the obtained image information can be printed without going through another information processing equipment such as a computer. Such system is extremely convenient in that an image taken by the digital camera or the digital video camera can be immediately and easily printed.

In using such printing apparatus as an image output apparatus for an image pickup device such as a digital camera, since the image pickup device is utilized as a mobile equipment, the printer apparatus is also required to be mobile by the consumers, and a compactness and a lighter weight are therefore necessary.

Prior technology for size reduction and reduction of components in such printing apparatus is disclosed for example in Japanese Patent Application Ladi-open No. 2001-151423. More specifically, this reference discloses a sheet feeding-discharging mechanism in such printing apparatus, including a conveying roller which is capable of conveying a recording medium in a direction toward printing means, and of which rotation enables a sheet feeding operation of feeding the recording medium in a conveying direction toward the printing means at a printing operation and a sheet discharging operation of reversing the recording medium after the printing in a direction opposite to the conveying direction and discharging thus reversed recording medium. In contrast to an ordinary sheet feeding-discharging mechanism of the printer, usually including two rollers, namely a sheet feeding roller and a sheet discharging roller, this technology can achieve sheet feeding and sheet discharging only with a conveying roller, thereby allowing to reduce the number of components and very effective in realizing a compact printer.

Also Japanese Patent Application Laid-open No. 2001-260471 discloses a technology on compactization of the printing apparatus. More specifically, this reference discloses a printing apparatus including a control board provided at a bottom side of the printing apparatus and executing at least either of a sheet feeding control and an ink ribbon feeding control, a power board provided at a lateral side of the printing apparatus and connected to battery terminals, and connection means for electrically connecting the control board and the power board, wherein the control board and the power board are mutually connected by an end of the control board and an end of the power board and thus connected boards are mounted in substantially L-shape close to an outer casing of the printing apparatus. This configuration allows to reduce the mounting area of the board by improving a mounting form and an arrangement of the circuit board including circuits necessary for the printing operation, and such technology is very effective in achieving a compact configuration of the printing apparatus.

However, such prior technologies as explained above alone are unable to meet the recent requirement for compact configuration, and also unable to provide a sufficient solution to other requirements for the printing apparatus such as a lower cost and a higher printing speed, and further improvements have therefore been desired for the technologies on such printing apparatus.

Now, let us consider a recording sheet to be used in such printing apparatus. In an ink jet printing apparatus or a copying apparatus, a plain paper can also be used as the recording sheet, and it is common that the user takes out a bundle of a necessary number of such recording sheets from a container of the paper and sets such bundle in a recording sheet tray of the printing apparatus.

On the other hand, a printing apparatus of sublimation or fusion thermal transfer type generally utilizes an exclusive recording sheet. Also in this case, it is common that the user takes out a bundle of a necessary number of such recording sheets from a container of the paper and sets such bundle in a recording sheet tray of the printing apparatus, or inserts the paper manually one by one into the apparatus.

Such method is associated with a drawback that the user is required to execute a cumbersome operation of setting the recording sheet in the recording sheet tray. Particularly in case of an exclusive recording sheet for use in a printing apparatus of thermal transfer type, there also result drawbacks that a manual contact with the recording sheet at the setting operation may lead to a defective printing and that an unused recording sheet set on the recording sheet tray may be smeared with dusts in case of a prolonged standing. Also in a product so designed by the manufacturer to provide a satisfactory print quality in an optimum combination of a recording sheet and an ink ribbon or a liquid ink, since the user may utilize another recording sheet, a recording sheet of inferior quality provided by a third party may be used to result in a deterioration in the print quality or in a sheet jamming in a worst case.

In order to cope with such drawbacks, various proposals are made for a printing apparatus and a recording sheet-containing package in which the recording sheet is supplied as a recording sheet containing package in a state set on a recording sheet tray and such package is directly mounted in a main body of the apparatus.

For example, Japanese Patent Application Laid-open No. 2001-213531 discloses technology on a recording liquid/recording sheet container, a recording sheet supply apparatus and a recording apparatus equipped therewith. The recording liquid/recording sheet container disclosed therein includes a case body portion to be detachably provided in a conveying mechanism constituting portion for conveying a recording sheet toward a recording part which executes a recording operation with a recording liquid on a recording surface of the recording sheet, a recording sheet container portion formed in the main body portion and containing the recording sheet, and a liquid container portion containing the liquid, and is so configured that the recording sheet taken out from the recording sheet container portion is discharged by a conveying force, outputted from the conveying mechanism constituting portion and acting on the recording sheet through a recording sheet discharge aperture formed on the case body portion.

Also Japanese Patent Application Laid-open No. 11-254700 discloses technology on an ink jet recording apparatus and a media cartridge. This reference discloses an ink jet recording apparatus including an ink jet head for printing by ink discharge on a recording medium, an ink tank for ink supply to the ink jet head, and a cassette portion for stacking recording media, wherein the cassette portion for stacking the recording media and the ink tank constitute a cartridge mounted on a same cassette portion and such cartridge is detachably mounted on the recording apparatus.

Also Japanese Patent Application Laid-open No. 11-41550 discloses technology on an image pickup apparatus with a printer and a cartridge unit. This reference discloses an image pickup apparatus with a printer including at least image pickup means for converting an optical image of an object field to be taken into an electronic image signal, and a printing apparatus for a visible print output of the electronic image signal, taken by the image pickup means, on a recording sheet, wherein a body of the image pickup apparatus with printer is so configured that a cartridge unit incorporating a print material can be detachably mounted, and includes attach/detachment detection means for detecting an attaching or a detaching of the cartridge unit and control means for controlling the operation mode, according to an attached or detached state of the cartridge unit detected by the attach/detachment detection means, so as to assume a print mode in the attached state or a camera mode in the detached state. This reference also discloses an image pickup apparatus with a printer, incorporating a printing apparatus of ink jet recording method, therein the apparatus includes a cartridge unit containing a cartridge body to be detachably mounted on a body of the apparatus, an ink tank containing ink of at least a color and a recording sheet for printing, and attachment detecting means is so configured that the supply of the ink and the recording sheet is executed when the cartridge unit is mounted on the body of the apparatus.

These prior technologies can contribute to the convenience of handling, since the user is not required to execute an operation of directly setting the recording sheet in the recording apparatus. However, the recording sheet containing package such as the recording liquid/recording sheet container, the media cartridge or the cartridge unit has excessively many components, therefore insufficient particularly in the cost, and is often not utilized widely for this reason. Also the recording sheet containing package of the prior technologies often becomes bulky because of the excessively many components, and such configuration is disadvantageous for realizing a mobile printer.

Also in the prior technologies, although the recording sheet containing package has to be replaced when all the containing recording sheets are exhausted and are therefore to be replaced relatively frequently, it is not clarified how such package should be disposed of after the use. A recording sheet containing package with many component parts is undesirable even for discarding as garbage, also requires a high recycling cost even in case such component parts are recycled. Further, the component parts constituting the recording sheet containing package are often constituted of plastic materials, requiring a post process requiring sufficient attention to the environment, such as burning in a satisfactory facility not generating toxic gases.

As explained in the foregoing, the prior technologies have been unable to provide a recording sheet containing package, convenient for use by the user and enabling disposal after use with sufficient attention to the environment.

SUMMARY OF THE INVENTION

The present invention has been made in consideration of the aforementioned drawbacks in the prior technologies, and is to provide a recording sheet containing package for containing recording sheets to be used in a recording apparatus, capable of ensuring convenient handling to the user, being formed inexpensively, also compact and light-weight for enabling easy carrying, and being disposable without a significant influence to the environment after the use.

The aforementioned object can be attained, according to the present invention, by a recording sheet containing package for containing a recording sheet for use in a recording apparatus and adapted to be mounted on the recording apparatus, constituted of two components which are a recording apparatus fitting portion to be fitted with the recording apparatus upon mounting thereon and a packaging member covering the circumference of the contained recording sheet.

Such configuration allows to easily mount the recording sheet containing package on the recording apparatus in a state enabling satisfactory printing on the recording sheet and to maintain such state, and also to prevent, by the packaging member, a detrimental effect by dust deposition or by manual contact on the recording sheet. The recording sheet containing package of the present invention, realizing these necessary functions by only two components, is inexpensive, easy to form light-weight and compact and is easily processible without a significant influence to the environment after the use.

In another embodiment of the present invention, the recording sheet containing package is constituted of three components, additionally including a protective paper fixed to the recording apparatus fitting portion and positioned between the contained recording sheet and the packaging member.

Such protective paper allows, particularly when the packaging member is formed by a plastic material, to prevent a detrimental influence to the recording sheet, caused by a prolonged contact between the recording surface of the recording sheet and the plastic material. Also the recording sheet containing package of this embodiment, realizing these necessary functions by only three components, is inexpensive, and easy to form light-weight and compact. Also in order to make it easily processible without giving a significant influence to the environment, the recording apparatus fitting portion is preferably formed by a molded part of a plastic material, particularly a biodegradable plastic material, and the packing member is preferably formed by paper or a plastic film, particularly by a biodegradable plastic film.

The recording apparatus fitting portion is provided with various functional portions such as recording sheet centering means, recording sheet rear end pressing means, a push-up plate, recording sheet pressing means, recording sheet separating means and means for limiting the mounting position in the transverse direction, and can realize the printing more satisfactorily. These functional parts can be integrally formed in the recording apparatus fitting portion constituted of a single component.

According to the present invention, by constituting the recording sheet containing package with two components of the recording apparatus fitting portion and the packaging member or three components further including the protective paper, it is rendered possible to realize the functions required for the recording sheet containing package, thus, while ensuring the convenience of the user, achieving inexpensiveness, also facilitating to attain light-weight and compactness and enabling processing after the use without significant influence to the environment.

Also the recording apparatus fitting portion can be integrally provided with various functional portions such as recording sheet centering means, recording sheet rear end pressing means, a push-up plate, recording sheet pressing means, recording sheet separating means and means for limiting the mounting position in the transverse direction, thereby realizing the recording operation more satisfactorily.

DESCRIPTION OF THE PREFERRED EMBODIMENTS

Now embodiments of the present invention will be explained with reference to accompanying drawings.

Figure 1:
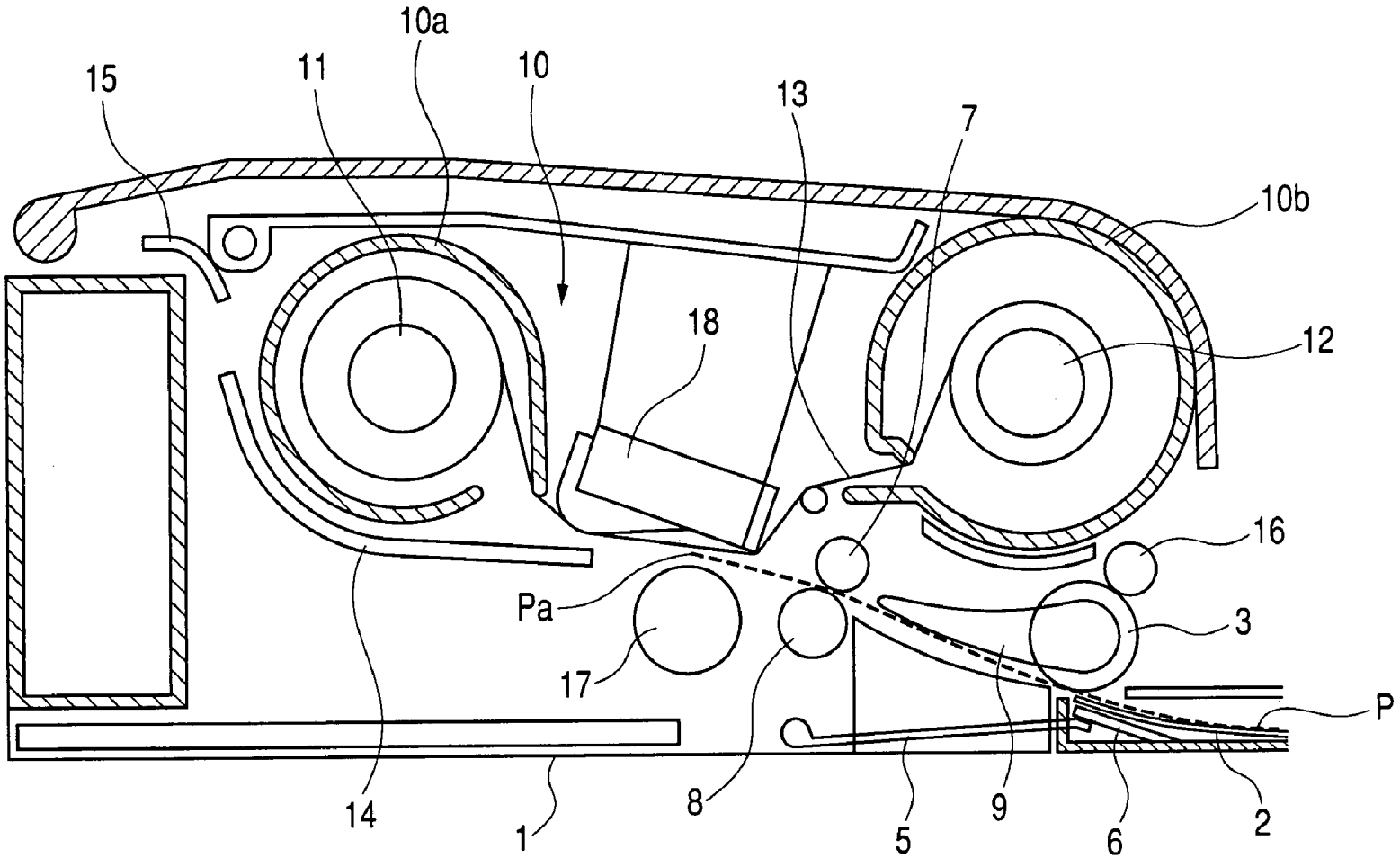
FIG. 1 is a cross-sectional view of an example of a recording apparatus in which a recording sheet containing packing embodying the present invention can be mounted, in a state where the supply of a recording sheet is started.
Figure 2:
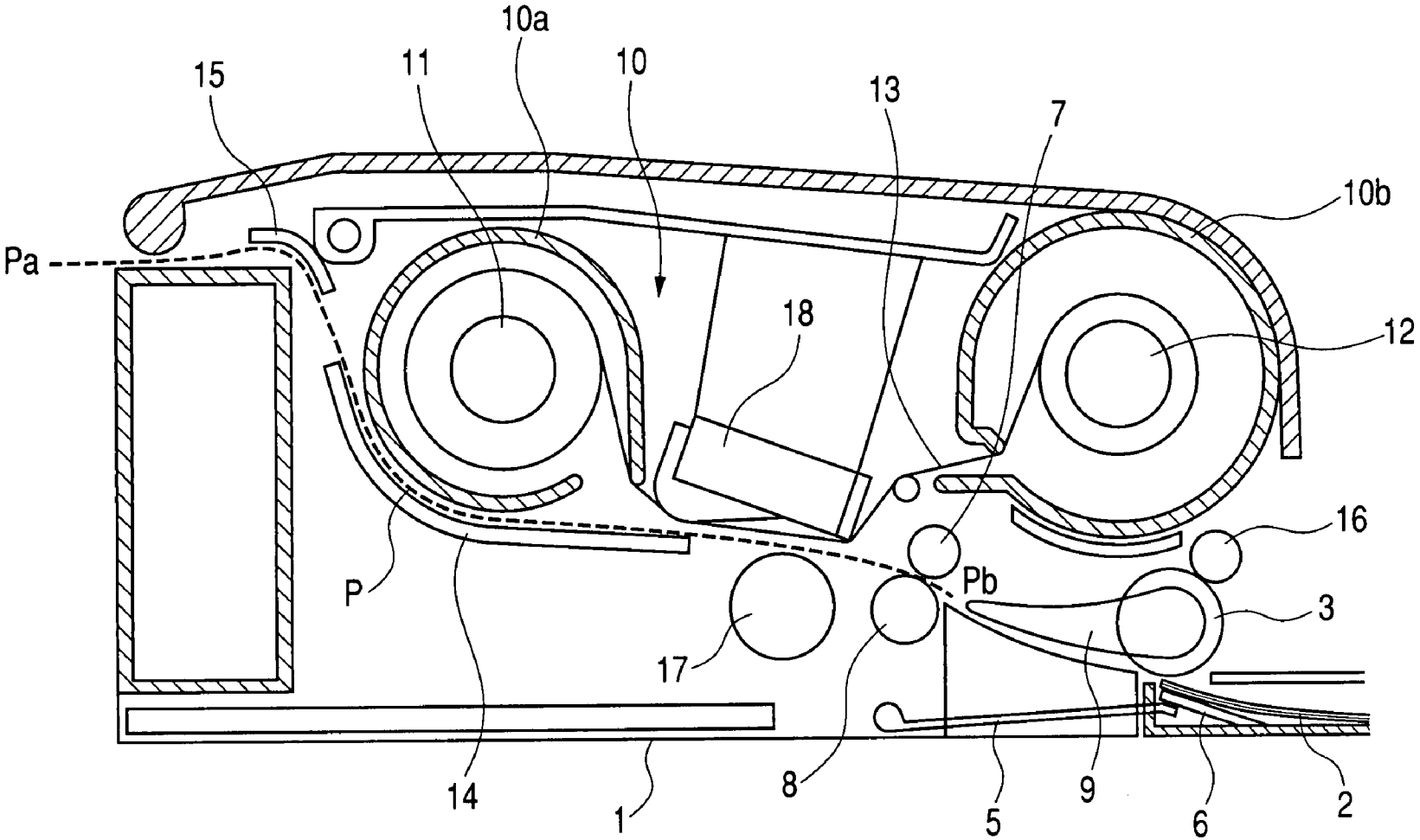
FIG. 2 is a cross-sectional view of the recording apparatus shown in FIG. 1, in a state where the recording sheet reaches a recording start position.
Figure 3:
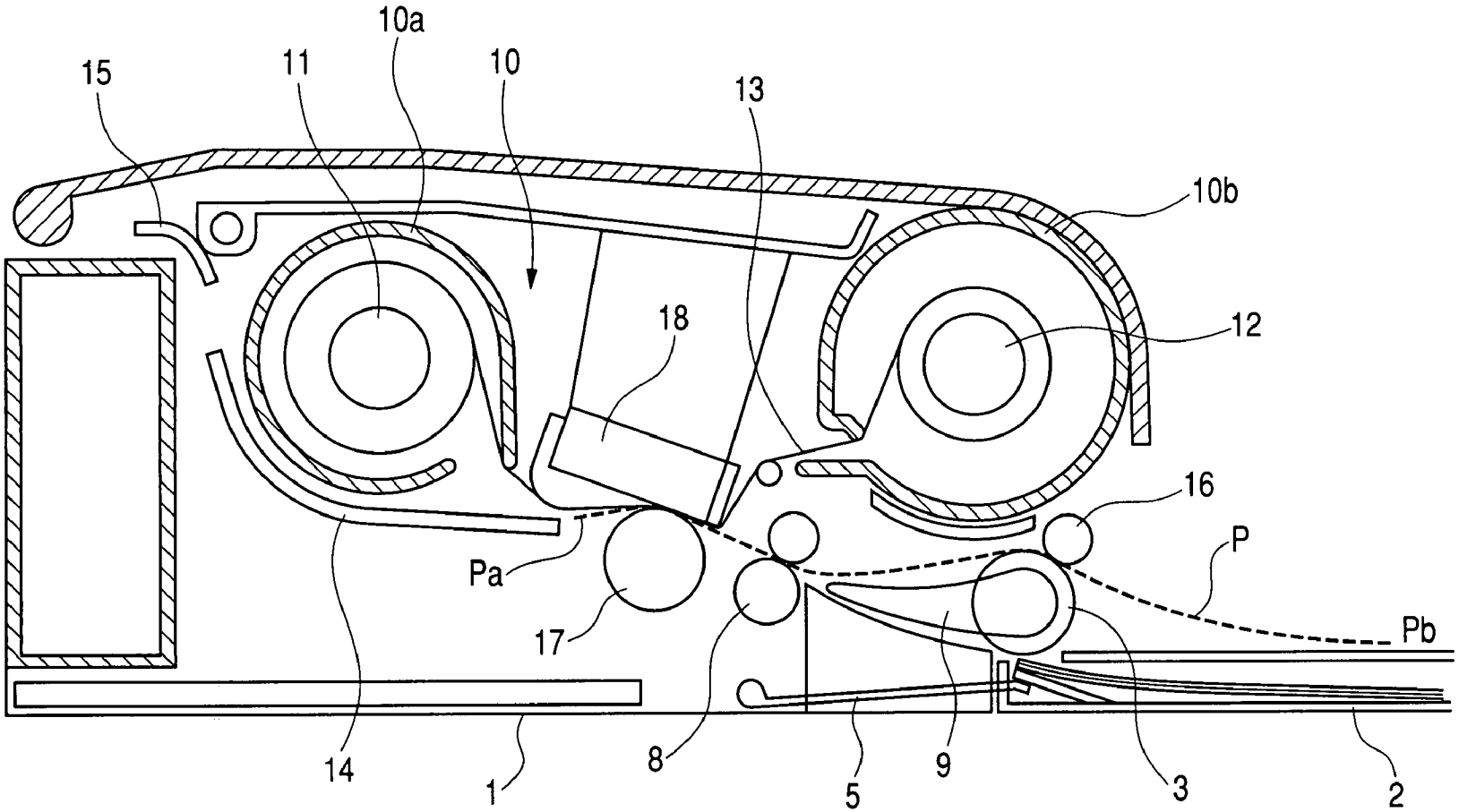
FIG. 3 is a cross-sectional view of the recording apparatus shown in FIG. 1, in a state where the recording sheet reaches a recording end position.

At first there will be explained, with reference to FIGS. 1 to 3, a configuration of an ordinary thermal transfer recording apparatus 1, as an example of the recording apparatus in which a recording sheet containing package of the present invention can be mounted. Such recording apparatus 1 is provided with a paper conveying part including a conveying roller 8 etc. and a printing part including a thermal head 18 etc.

In the paper conveying part, a paper feeding roller 3 (paper feeding means) is provided in a position above a front end portion of plural recording sheets P contained in a recording sheet containing package 2 in a state mounted in a main body of the recording apparatus 1. The recording sheet containing package 2 is provided, as will be explained later, with a push-up plate 6 positioned below the front end portion of the contained recording sheets P and displaceable upwards, and the recording apparatus 1 is provided with a push-up lever 5 so mounted as to be capable of rocking and impinging on the push-up plate 6. The push-up lever 5 is capable of a rocking motion by an unillustrated cam gear to displace the push-up plate 6 thereby bringing the front end of the recording sheet P in contact with the paper feeding roller 3.

At the position of the paper feeding roller 3, a path switching flap 9 is provided extending from the center of the paper feeding roller 3 toward the interior of the recording apparatus 1, and such path switching flap 9 defines conveying paths for guiding the recording sheet P above and below. A conveying path under the path switching flap 9 extends from the position of the recording sheet containing package 2 to a nip between a conveying roller 8 and a pinch roller 7, while a discharged sheet pressing roller 16 in contact with the paper feeding roller 3 is provided in the upper conveying path. The paper feeding roller 3 and the conveying roller 8 are connected to an unillustrated drive source through a drive transmission mechanism when necessary, thus being rotated respectively. The recording sheet P can be reciprocated through a printing part by the paper feeding roller 3.

On the conveying path of the recording sheet P conveyed by the conveying roller 8, there are provided a thermal head 18 having heat generating elements that can be selectively heated, and a platen roller 17 opposed to a surface of such head, and these components constitute a printing part or recording means. The platen roller 17 can be vertically moved by an unillustrated drive source through a cam gear. The cam gear for displacing the platen roller 17 is integrally formed with the cam gear for rocking the push-up lever 5.

The thermal head 18 has a supporting portion capable of rocking motion, and can be rocked for mounting an ink cassette 10 in such a manner that an ink sheet 13 can contact the head surface of the thermal head 18. The ink cassette 10 is provided with a ribbon supply portion 10*a* including a supply bobbin shaft 11 on which an unused side of the ink sheet 13 is wound and a tubular case surrounding an external circumference thereof, and a ribbon take-up portion 10*b* including a take-up bobbin shaft 12 on which a used side of the ink sheet 13 is wound and a tubular case surrounding an external circumference thereof. The tubular cases of the ribbon supply portion 10*a* and the ribbon take-up portion 10*b* are connected by an unillustrated connecting member.

The ink sheet 10 includes an ink layer formed by coating a heat fusible or sublimable ink, and an overcoat layer which is to be overcoated on the printed surface for protection. Such ink layer and overcoat layer are formed over an entire width of the recording sheet P recordable by the recording apparatus 1 and have widths substantially same as a width of the recording sheet P, and ink layers of yellow (Y), magenta (M) and cyan (C) and an overcoat layer (OP) are formed in succession in the conveying direction of the ink sheet 10.

In a mounted state of the ink cassette 10, a predetermined gap is formed between a cassette guide 14 constituting an ink cassette mounting portion in the recording apparatus 1 and the ribbon supply portion 10*a*, and constitutes a conveying path for the recording sheet P conveyed beyond the printing part by the conveying roller 8, and a paper guide 15 is provided in a position to be contacted by a front end Pa of the recording sheet P passing through such conveying path, for guiding the recording sheet P to a gap open to the exterior of the recording apparatus 1.

In the following, a recording operation by the recording apparatus 1 will be outlined.

At first a preparation for recording is made by mounting the ink cassette 10 and the recording sheet containing package 2 on the recording apparatus 1. When a recording operation is initiated, the recording sheets P contained in the recording sheet containing package 2 are brought into contact with the paper feeding roller 3 by an upward displacement of the push-up plate 6 through the cam gear and the push-up lever 5. In this state, the paper feeding roller 3 is rotated to separate and feed an uppermost one of the recording sheets P contained in the recording sheet containing package 2.

Then the recording sheet P fed by the paper feeding roller 3 is supported by paired conveying rollers constituted of the pinch roller 7 and the paper conveying roller 8. Then the recording sheet P is further conveyed by the paired conveying rollers to the interior of the recording apparatus 1, whereby, as indicated by a broken line in FIG. 1, the front end Pa of the recording sheet P passes the printing part.

Then the recording sheet P is further conveyed until a rear end Pb of the recording sheet P leaves the paper feeding roller 3 and then passes through under the path switching flap 9. This state, indicated by a broken line in FIG. 2, is a print start position in the recording apparatus 1, and the recording sheet P is not conveyed further in this direction. In this state, though dependent on the size of the recording sheet P, the front end Pa of the recording sheet P passes through the gap between the ink cassette 10 and the cassette guide 14, and, with a deflection of direction by the paper guide 15, protrudes from the upper rear part of the body of the recording apparatus, as illustrated in FIG. 2.

The printing operation is executed by conveying the recording sheet P from the print start position toward the front side of the recording apparatus 1, namely toward a side where the paper feeding roller 3 is situated. At the printing operation, the platen roller 17 is moved upwards thereby pressing the recording sheet P and the ink sheet 13 to the head surface of the thermal head 18 under an appropriate pressure. In this state, the heat generating elements of the thermal head 18 are selectively heated according to a recording signal based on recording image information, whereby the ink layers of respective colors and the protective layer are thermally transferred selectively and in succession. In this operation, the recording sheet P is returned to the original position after thermal transfer of each layer, whereby each line-shaped area of the recording sheet P is subjected to successive transfers of the layers.

The recording sheet P is conveyed toward the front side, with successive printing in the line-shaped area in this manner. In this operation, the rear end Pb of the recording sheet P is guided, different from the paper feeding operation, to the upper conveying path above the path switching flap 9, then, after passing above the path switching flap 9, passes between the paper feeding roller 3 and the discharged sheet pressing roller 16 and is discharged from the body of the apparatus 1. Such print completion state is indicated by a broken line in FIG. 3.

After the printing, the recording sheet P is further conveyed toward the front side of the recording apparatus 1 by rotation of the paper feeding roller 3, and, after the front end Pa of the recording sheet leaves the paired conveying rollers, the recording sheet P is conveyed only by a supporting power between the paper feeding roller 3 and the paper pressing roller 16 and is discharged onto an upper surface of the recording sheet containing package 2.

In the following there will be explained, with reference to FIGS. 4 to 8, a configuration of the recording sheet containing package 2 constituting an embodiment of the present invention.

Figure 4:
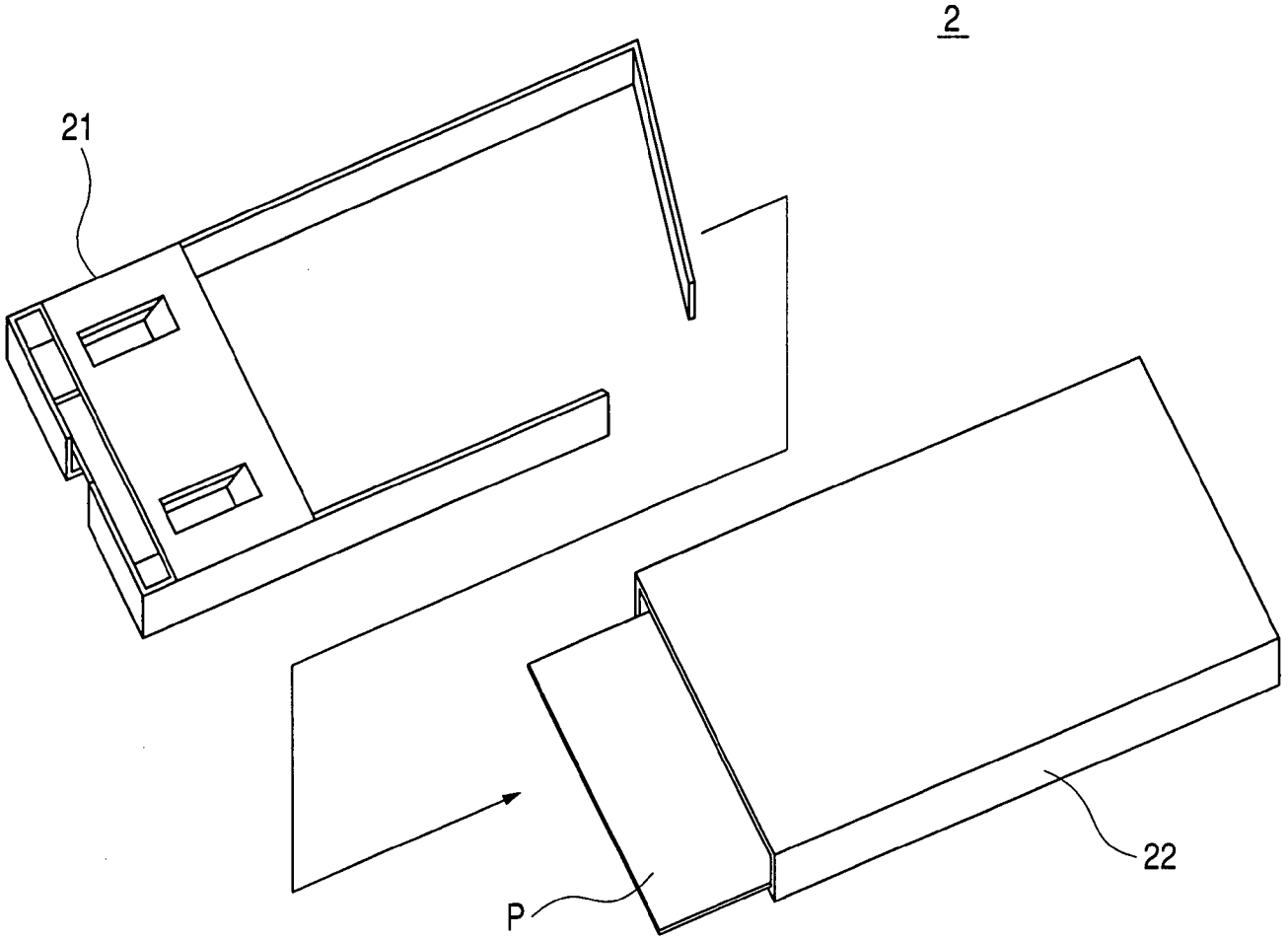
FIG. 4 is an exploded perspective view of a recording sheet containing package embodying the present invention.

As shown in FIG. 4, the recording sheet containing package 2 is constituted of two components, namely a recording apparatus fitting portion 21 for principally maintaining a stable mounted state by fitting into the recording apparatus 1, and a packaging member 22 packing the contained recording sheets P. The recording apparatus fitting portion 21 is constituted of a plastic molded component of a molding resin such as ABS. On the other hand, the packaging member 22 is formed by paper or polyethylene terephthalate (PET), and bears indications of a trade mark and a type of the recording sheet P on the surface.

Figure 7:
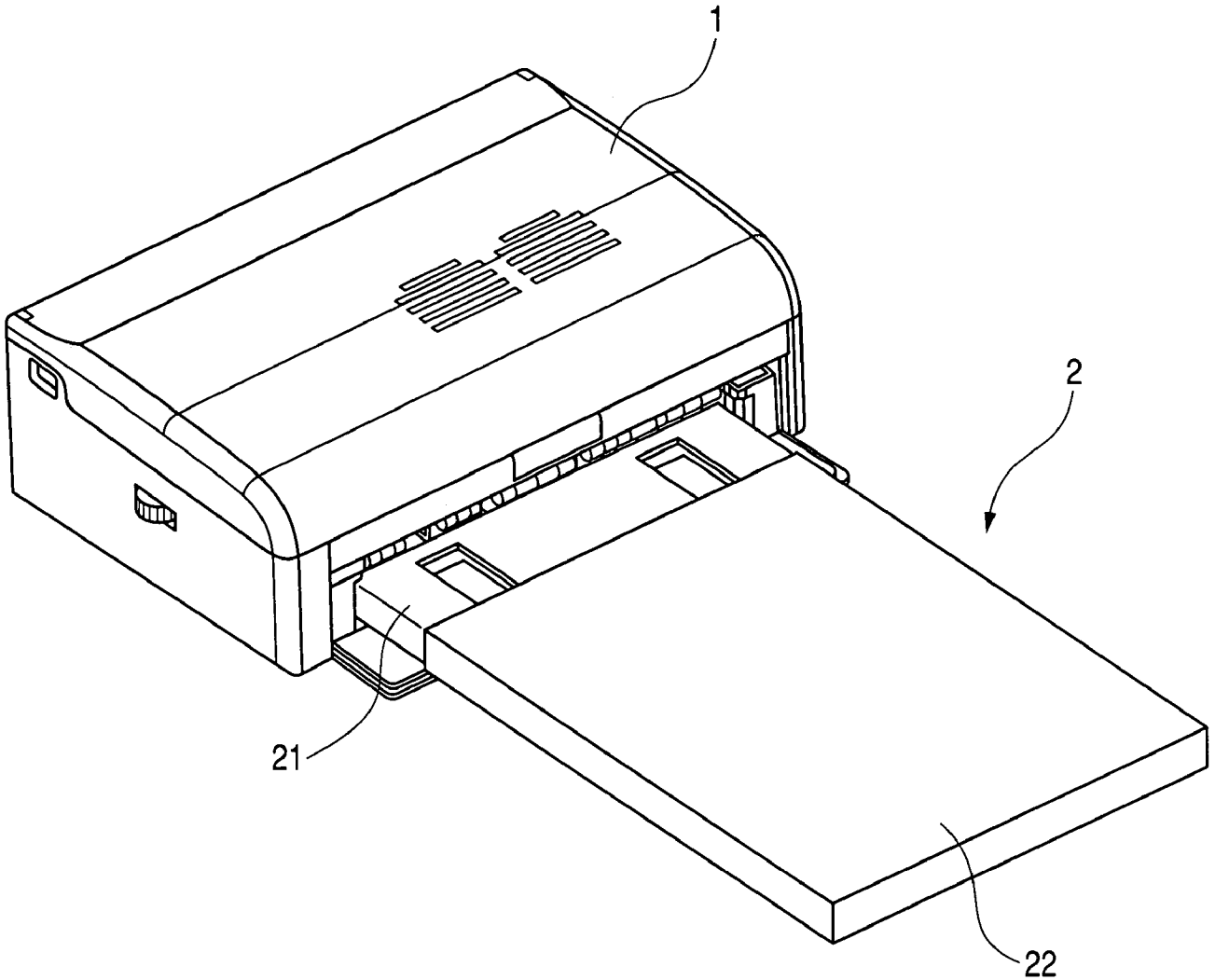
FIG. 7 is a perspective view showing a state in which the recording sheet containing package shown in FIG. 4 is mounted on the recording apparatus shown in FIG. 1.
Figure 8:
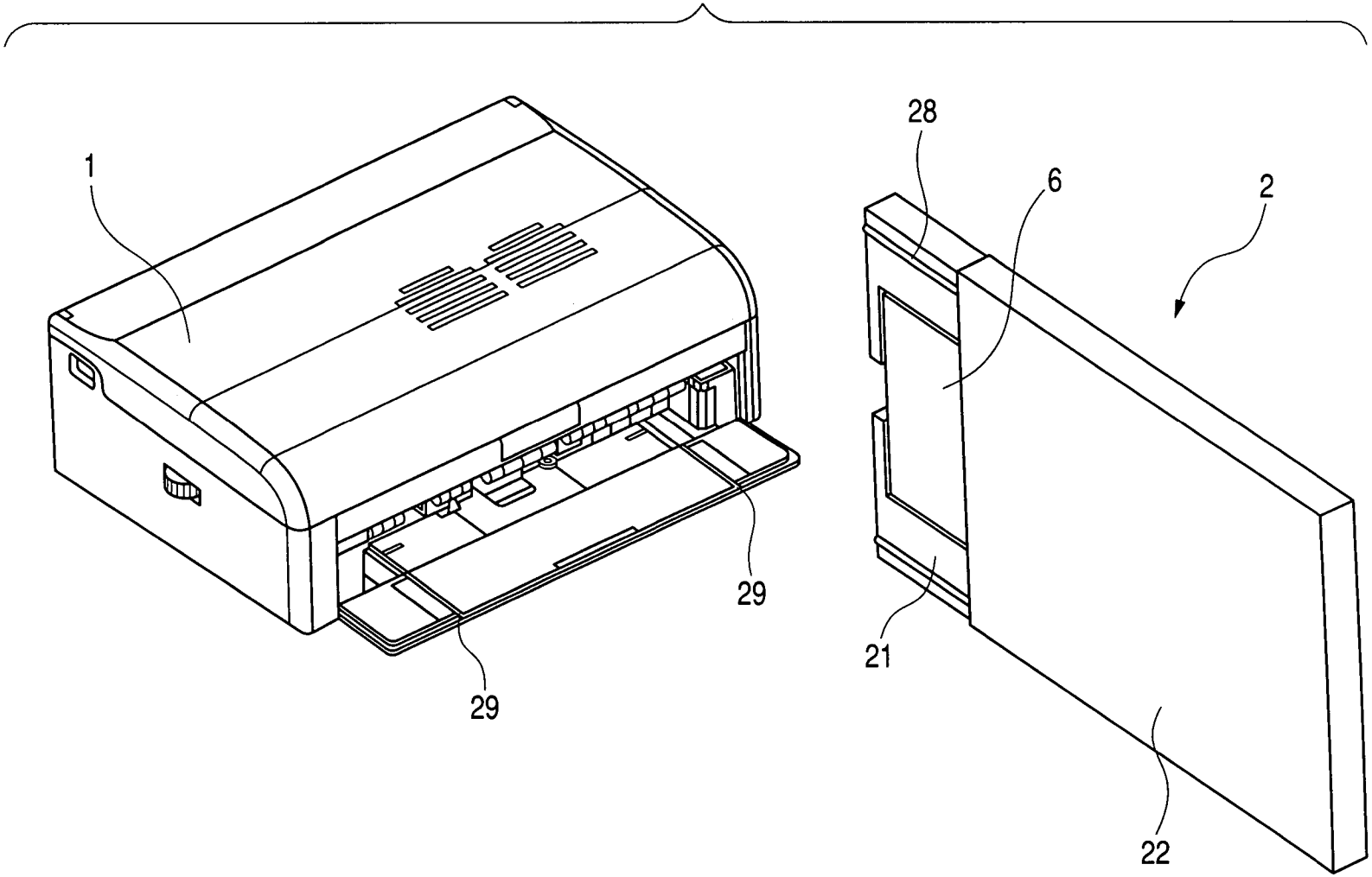
FIG. 8 is a perspective view showing a fitting portion between the recording apparatus shown in FIG. 1 and the recording sheet containing package shown in FIG. 4.

As shown in FIG. 7, the recording sheet containing package 2 is mounted in a mounting portion of the recording apparatus 1, by inserting a front end portion formed by the recording apparatus fitting portion 21. As shown in FIG. 8, in the mounting portion of the recording apparatus 1, a groove 29 extending in the mounting direction of the recording sheet containing package 2 is formed on each of the transverse ends, and, on a bottom surface of the recording apparatus fitting portion 21, a projection 28 extending in the mounting direction is formed close to each of the transverse ends. The recording sheet containing package 2 is mounted by a sliding motion under fitting of the projections 28 with the grooves 29. The recording sheet containing package 2 may be prepared in types containing the recording sheets P of plural sizes such as a card size, an L size and a post-card size, and, any recording sheet containing package 2 containing the recording sheet P of any size may be so aligned that a center line of the recording sheet containing package 2 in the transverse direction matches a center line of the mounting portion by fitting the projections 28 with the grooves 29. Thus the projections 28 of the recording apparatus fitting portion 21 constitute means for defining the mounting position of the recording sheet containing package 2 in the transverse direction.

Figure 5:
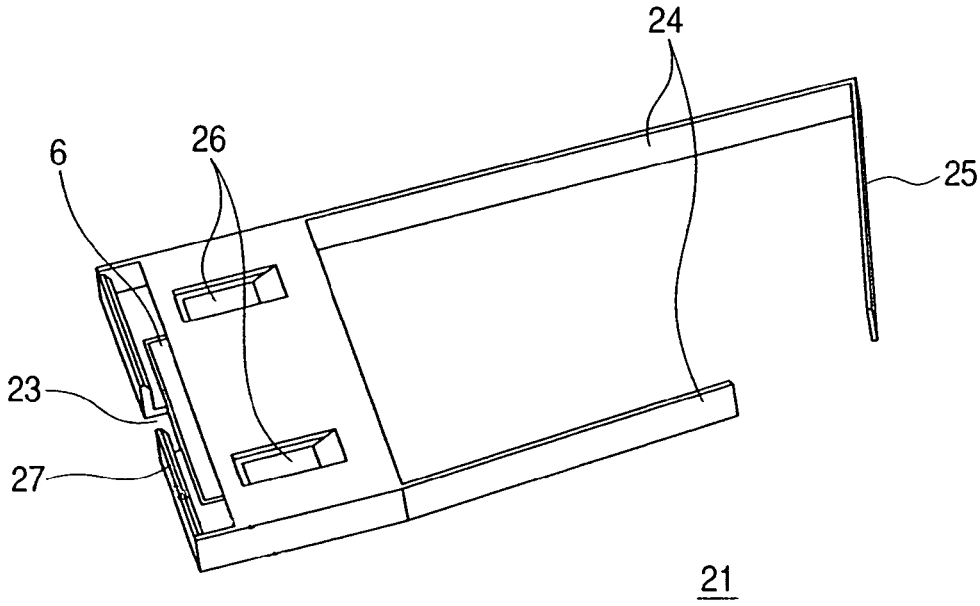
FIG. 5 is a perspective view of a recording apparatus fitting portion of the recording sheet containing package shown in FIG. 4.
Figure 6:
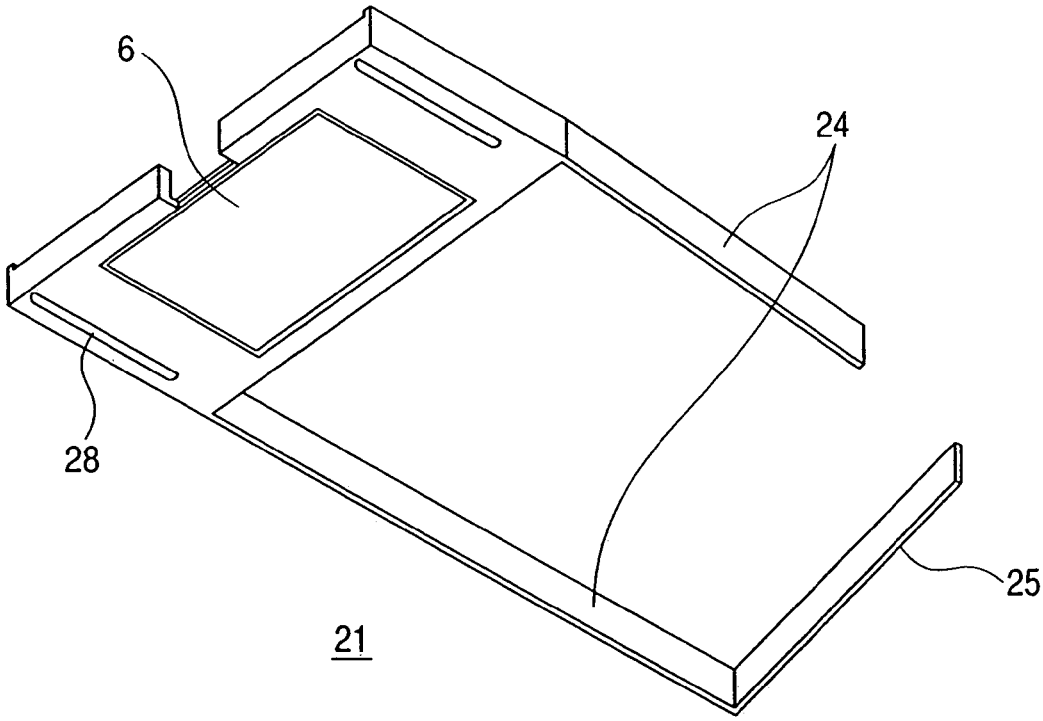
FIG. 6 is a perspective view, seen from below, of the recording apparatus fitting portion shown in FIG. 5.

The recording apparatus fitting portion 21 is provided, in a front end portion to be fitted in the recording apparatus 1, with a box-like shape surrounding a front end portion of the plural recording sheets P contained therein. In a frontmost portion on the upper surface of the box-like shape, an aperture extending over the entire width is formed for taking out the recording sheet P as shown in FIG. 5.

A front wall of the recording apparatus fitting portion 21 has an upper edge so shaped, at the feeding of the recording sheets P, as to contact the front ends thereof thereby separating an uppermost recording one thereof, thereby constituting a separating bank 27. The separating bank 27 has a limiting surface (surface of the front wall) for limiting the front ends of the stacked recording sheets, and the limiting surface is provided, at least in an upper end thereof, with an inclined surface for separating and passing the uppermost recording sheet only. An angle and a dimension of such limiting surface are advantageously determined in overall consideration of stiffness and thickness of the recording sheet P and a frictional force of the paper feeding roller 3. The configuration having the separating bank 27 in the recording sheet containing package 2 is preferable since the shape of such separating bank 27 can be optimized to the characteristics of the recording sheets P contained in such recording sheet containing package 2. Also the separating bank 27 is preferably provided at a precise position to the paper feeding roller 3 for achieving satisfactory separation of the recording sheet P. Such precise positioning of the separating bank 27 with respect to the paper feeding roller 3 can be realized by exact positioning of the recording apparatus fitting portion 21 by fitting thereof to the mounting portion of the recording apparatus 1.

The front wall of the recording apparatus fitting portion 21 including the separating bank 27 is provided with a recess of a predetermined size at the approximate center, constituting a portion 23 for inserting the paper feeding roller. More specifically, when the recording sheet containing package 2 is mounted on the recording apparatus 1, the paper feeding roller inserting portion 23 constitutes an escapement in which the paper feeding roller 3 can intrude and can be positioned directly above the front end of the recording sheet P contained in the package.

The aforementioned push-up plate 6 is formed on a lower surface of the front box-shaped part formed by the recording apparatus fitting portion 21. The push-up plate 6 has a rectangular shape, which is separated from a surrounding area at edges other than a rear edge and has a thin connecting part at the rear edge, thereby being rendered capable of a rocking motion about such rear edge. The push-up plate 6 of such configuration can be formed integrally with other portions of the recording apparatus fitting portion 21, by making cut edges on the lower surface of the box-shaped portion and forming the read edge portion thinner. The push-up plate 6 preferably has a sufficient size particularly in the transverse direction in order to press, when the push-up plate 6 is displaced upwards by the push-up lever 5, the recording sheet P to the paper feeding roller 3 not locally but in a wide range thereby enabling satisfactory feeding of the recording sheet P by the paper feeding roller 3.

On the upper wall of the box-shaped portion of the recording apparatus fitting portion 21, pressing portions 26 protruding downwards for pressing the upper surface of the recording sheet P are provided in the vicinity of both ends in the transverse direction. Such pressing portions 26 for the upper surface of the recording sheet serve, when the front end of the recording sheet P is pushed up by the push-up plate 6, to limit an upward movement of the upper surface of the recording sheet P, positioned a little behind the frontmost part thereof. Even when the recording sheet P is bent for example by a curling, such pressing portions 26 for the upper surface of the recording sheet, press the recording sheet P with a weak force enough for correcting the bending to prevent floating thereof and to satisfactorily contact the front end portion of the recording sheet P with the paper feeding roller 3 thereby achieving satisfactory application of the frictional force and satisfactory feeding of the recording sheet P.

The recording apparatus fitting portion 21 is also provided, next to the aforementioned box-shaped portion, with one-side pressing springs 24, extending along both lateral edges of the contained recording sheets P. The one-side pressing springs 24 are so configured to apply an elastic force to the recording sheets P toward the center in the transverse direction, thus constituting recording sheet centering means for regulating the contained position of the recording sheets P at the center of the recording sheet containing package 2. By thus regulating the contained position of the recording sheet P in an appropriate position in the transverse direction, it is rendered possible to maintain the recording sheet P, conveyed to the thermal head 18 of the recording apparatus 1, at an appropriate constant position in the transverse direction, thereby obtaining an appropriate print position.

Otherwise, in case a side is taken as reference, there may be adopted a configuration of forming a reference guide (end position limiting member) on the reference side instead of the one-side pressing spring 24 and pressing the recording sheet to the reference guide by a one-side pressing spring provided on the other side.

Furthermore, in continuation of a one-side pressing spring 24, there is formed a pressing portion 25 for the rear end of the recording sheet, extending along the rear end of the contained recording sheet P. Such recording sheet rear end pressing portion 25 is so configured to apply an elastic force to the recording sheet P toward a limiting surface 27 at the front end side. Such configuration allows to prevent the contained recording sheet P from sliding behind even in case the recording sheet P is formed by a soft paper or a plastic film, thereby maintaining the recording sheet P in an appropriate contained position in the front-back direction. Such appropriate contained position of the recording sheet P in the front-back direction allows to prevent a failure in the feeding.

The packaging member 22 is fixed by adhesion to the aforementioned recording apparatus fitting portion 21. Therefore the contained recording sheet P is surrounded in the circumference except for the extracting aperture at the front end, and is therefore protected from being smeared by dusts or from being touched carelessly.

In the embodiment explained in the foregoing, the recording sheet containing package 2 is constituted of minimum necessary two components, namely the recording apparatus fitting portion 21 for fitting in the recording apparatus 1 and maintaining the contained recording sheet P in an appropriate mounted position thereby enabling a satisfactory recording operation, and the packaging member 22 covering the circumference of the contained recording sheet P thereby protecting the recording sheet P from the detrimental influence of dusts and human contact. Therefore the recording sheet containing package 2 of the present embodiment can be produced with a low manufacturing cost, and can also be made compact and light-weight suitably for the recording apparatus for which mobile property is required. Because of the limited number of components, it can also be made easily recyclable, or it can be easily processed even in case of discarding. Thus the recording sheet containing package of the present embodiment can be made with small burden to the environment.

In order to facilitate discarding, the recording apparatus fitting portion 21 and the packaging member 22 may be formed by a biodegradable plastic material. Also the recording apparatus fitting portion 21 is required to have a certain strength in order to be fittable with sufficient precision and strength to the recording apparatus 1, and the present embodiment has shown an example of formation with a plastic mold. However, the recording apparatus fitting portion 21 may also be formed with a hard paper, since it is required to maintain the necessary enough strength and precision only for a relatively short period until the predetermined number of the recording sheets P contained in the recording sheet containing package 2 is consumed.

Also the recording apparatus fitting portion 21 can be provided with various functional portions such as the recording sheet centering means (one-side pressing spring 24) for centering the contained position of the recording sheet P in the transverse direction, the means for pressing the rear end of the recording sheet (recording sheet rear end pressing portion 25) for biasing toward the front side, the push-up plate 6 allowing to bias the recording sheet P toward the paper feeding roller 3 of the recording apparatus 1, the recording sheet pressing means (recording sheet upper surface pressing portion 26) for limiting the upward displacement of the recording sheet P when it is pushed up thereby correcting the bending, the recording sheet separating means (separating bank 27) contacting the front end of the recording sheets P other than the uppermost one at the feeding by the paper feeding roller 3 thereby preventing feeding of such contacted recording sheets and allowing the uppermost recording sheet P alone to be separated and fed, and the transverse mount position limiting means (projection 28) for obtaining an appropriate mounting position of the recording sheet containing package 2 in the transverse direction even in case it contains the recording sheet P of varied sizes. These various functional portions can be integrally incorporated in the single component of the recording apparatus fitting portion 21 so that the number of components is not increased.

In the present embodiment, there has been shown an example in which the projections 28 are formed on the bottom surface of the recording apparatus fitting portion 21 as the transverse mount position limiting means, but there may also be adopted a configuration in which the projections are formed on the mounting portion of the recording apparatus 1 and the grooves on the recording apparatus fitting portion 21. Also these projections and grooves may be provided on the upper surface side of the recording sheet containing package 2. Otherwise, there may also be adopted a configuration in which a projection protruding frontward is formed at the front end of the recording apparatus fitting portion 21 and is fitted with a recess provided in the mounting portion of the recording apparatus 1, or a configuration in which a recess is formed at the front end of the recording apparatus fitting portion 21 and a projection is formed in the mounting portion of the recording apparatus 1.

Also, as shown in the present embodiment, the recording sheet P employed in the thermal transfer recording apparatus 1 is generally subjected to a certain surface treatment on the recording surface in order to satisfy printing performance, and such surface of the recording sheet, in case contacted with a plastic material for a long period, may be denatured and may show a change in the printing performance. For this reason, in case plastics are employed in the packaging material, a protective paper is conventionally inserted between the recording sheet and the plastic packaging material in order to protect the surface of the recording sheet. Such protective paper, being not usable for printing, is removed in the prior technology by the user at the setting of the recording sheet on the recording sheet tray of the recording apparatus. Also in the present embodiment, a protective paper is preferably provided between the packaging member 22 and the recording sheet P in case the packaging member 22 is formed by a plastic material.

Figure 9:
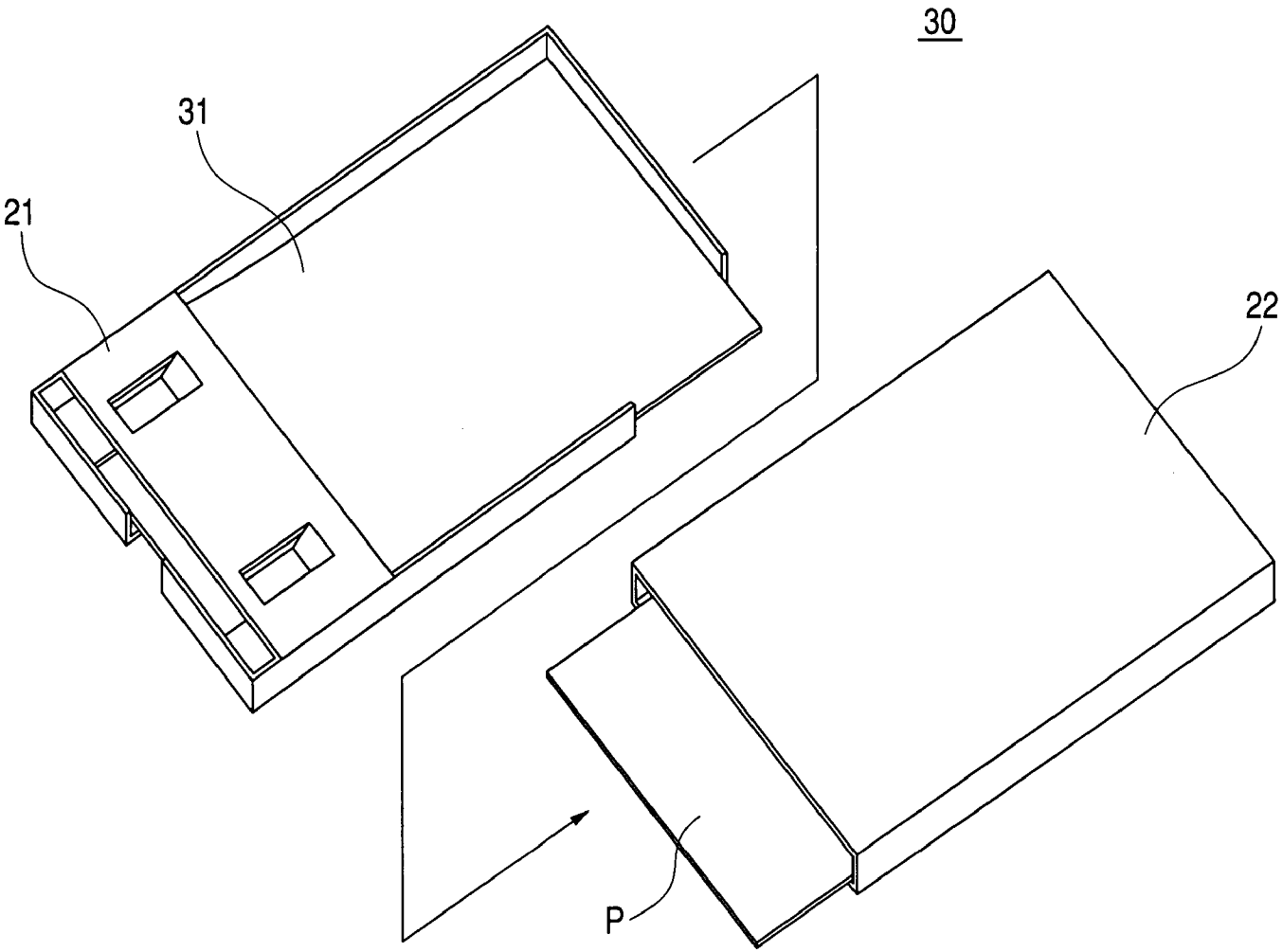
FIG. 9 is an exploded perspective view of a variation of the recording sheet containing package shown in FIG. 4.

A recording sheet containing package 30 including such protective paper 31 is shown in FIG. 9. In the configuration shown in FIG. 9, the protective paper 31 is fixed to the recording apparatus fitting portion 21. Therefore the protective paper 31 is not conveyed at the feeding operation but always remains positioned between the recording surface of the uppermost recording sheet P and the packaging member 22 until all the recording sheets P contained in the recording sheet containing package 30 are exhausted, thereby preventing a detrimental effect on the surface of the recording sheet P by the contact with the plastic packaging member 22.

Figure 10:
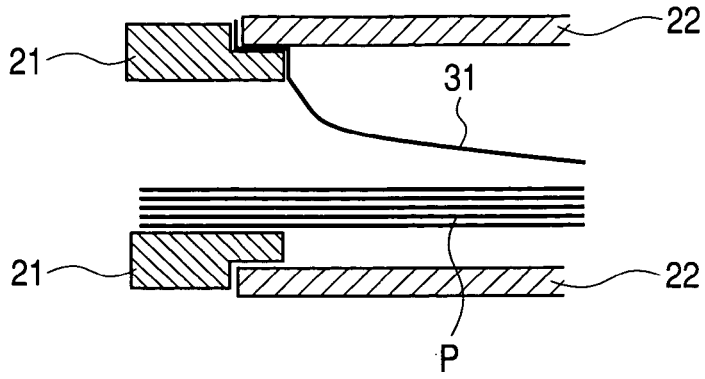
FIG. 10 is a cross-sectional view showing a configuration of mounting a protective paper in the recording sheet containing package shown in FIG. 9.
Figure 11:
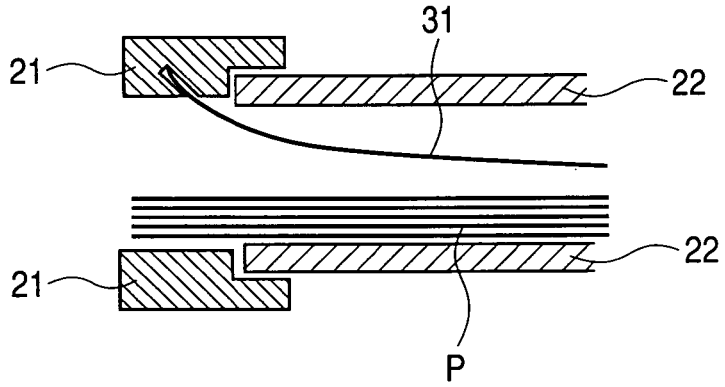
FIG. 11 is a cross-sectional view showing another configuration of mounting the protective paper in the recording sheet containing package shown in FIG. 9.
Figure 12:
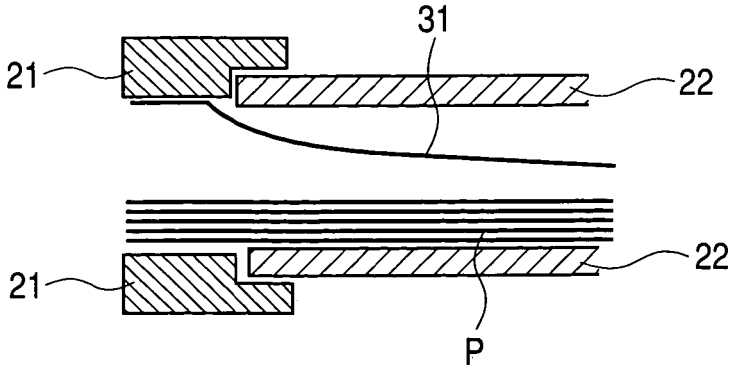
FIG. 12 is a cross-sectional view showing still another configuration of mounting the protective paper in the recording sheet containing package shown in FIG. 9.

For fixing the protective paper 31 to the recording apparatus fitting member 21, there may be adopted a configuration shown in FIG. 10 in which a front end of the protective paper 31 is pinched between the recording apparatus fitting member 21 and the packaging member 22, or a configuration shown in FIG. 11 in which a front end of the protective paper 31 is fitted in a recess formed in the recording apparatus fitting portion 21, or a configuration shown in FIG. 12 in which a front end of the protective paper 31 is adhered to a lower surface of the upper wall of the recording apparatus fitting portion 21.

The foregoing embodiments have been explained with a thermal transfer printer as an example of the recording apparatus 1 in which the recording sheet containing package 2 is mounted, but a printing apparatus of ink jet method may also be used. The recording sheet containing package 2 of the present embodiment can be employed basically without any change even in the latter case.

In case an ink jet method is employed in the recording apparatus 1, there is preferably employed an ink discharge method of energizing an electrothermal converting member according to a recording signal based on recording image information, inducing a film boiling in the ink by the thermal energy generated by the electrothermal converting member to generate a bubble in the ink and discharging the ink from a discharge port by growth and shrinkage of such bubble thereby achieving a recording. A liquid discharge excellent in responsiveness can be attained by the ink discharge utilizing growth and shrinkage of the bubble by thermal energy.

What is claimed is:

1. A recording sheet containing package for containing a recording sheet for use in a recording apparatus, the package comprising two components which are a recording apparatus fitting portion to be fitted in said recording apparatus via means provided on said recording apparatus fitting portion which fit with corresponding means provided on said recording apparatus thereby defining a position of said recording apparatus and a packaging member covering a circumference of said contained recording sheet, wherein said recording apparatus fitting portion includes a front wall for limiting movement of said contained recording sheet in an extracting direction by contacting a leading end of said contained recording sheet in the extracting direction;

wherein said recording apparatus fitting portion includes a recording sheet rear end pressing means which extends along a rear edge of said contained recording sheet in the extracting direction thereof and applies an elastic force to said contained recording sheet in the extracting direction so that a front end of said contained recording sheet abuts said front wall; and wherein said packaging member is exposed when said recording apparatus fitting portion is fitted in said recording apparatus.

2. A recording sheet containing package for containing a recording sheet for use in a recording apparatus, the package comprising three components which are a recording apparatus fitting portion to be fitted in said recording apparatus via means provided on said recording apparatus fitting portion which fit with corresponding means provided on said recording apparatus thereby defining a position of said recording apparatus, a packaging member covering a circumference of said contained recording sheet, and a protective paper positioned between said contained recording sheet and said packaging members, wherein said recording apparatus fitting portion includes a front wall for limiting movement of said contained recording sheet in an extracting direction by contacting a leading end of said contained recording sheet in the extracting direction;

wherein said recording apparatus fitting portion includes a recording sheet rear end pressing means which extends along a rear edge of said contained recording sheet in the extracting direction thereof and applies an elastic force to said contained recording sheet in the extracting direction so that a front end of said contained recording sheet abuts said front wall; and wherein said packaging member is exposed when said recording apparatus fitting portion is fitted in said recording apparatus.

3. The recording sheet containing package according to claim 1 or 2, wherein said recording apparatus fitting portion is constituted of a molded part of a plastic material.

4. The recording sheet containing package according to claim 3, wherein said plastic material is a biodegradable plastic material.

5. The recording sheet containing package according to claim 1 or 2, wherein said recording apparatus fitting portion is constituted of a hard paper.

6. The recording sheet containing package according to claim 1 or 2, wherein said packaging member is constituted of a paper.

7. The recording sheet containing package according to claim 1 or 2, wherein said packaging member is constituted of a plastic film.

8. The recording sheet containing package according to claim 7, wherein said plastic film is constituted of a biodegradable plastic material.

9. The recording sheet containing package according to claim 1 or 2, wherein said recording apparatus fitting portion includes recording sheet centering means which extends along each of both edges of said contained recording sheet lateral to an extracting direction thereof and applies an elastic force to said recording sheet toward the center.

10. The recording sheet containing package according to claim 1 or 2, wherein said recording apparatus fitting portion includes recording sheet rear end pressing means which extends along a rear edge of said contained recording sheet in an extracting direction thereof and applies an elastic force to said recording sheet in the extracting direction.

11. The recording sheet containing package according to claim 1 or 2, wherein said recording apparatus fitting portion includes an aperture for exposing a surface of a front end portion of said contained recording sheet in an extracting direction thereof and a push-up plate in contact with said recording sheet at a surface opposite to said aperture and capable of displacing said recording sheet in a direction toward said aperture.

12. The recording sheet containing package according to claim 11, wherein said recording apparatus fitting portion further includes recording sheet pressing means which protrudes toward a surface of said recording sheet exposed by said aperture, in a position behind said aperture in the extracting direction of said recording sheet.

13. The recording sheet containing package according to claim 11, wherein said recording apparatus fitting portion further includes recording sheet separation means which displaces said push-up plate upwards thereby pressing a surface of said recording sheet exposed by said aperture to a feeding roller of said recording apparatus, and, when said recording sheet is fed by a rotation of said feeding roller, contacts a front end of said recording sheet in an extracting direction thereby preventing feeding of said recording sheet except for a recording sheet positioned closest to said feeding roller.

14. The recording sheet containing package according to claim 1 or 2, wherein said means provided on said recording apparatus fitting portion includes transverse mount position limiting means which limits a mounting position in transverse to a mounting direction to a specified position.

15. The recording sheet containing package according to claim 14, wherein said transverse mount position limiting means is constituted of a groove or a projection of a rail-like shape extending in the mounting direction.

16. The recording sheet containing package according to claim 14, wherein said transverse mount position limiting means is constituted of a recess or a projection provided in a front end in the mounting direction.

17. A recording sheet containing package for containing a recording sheet for use in a recording apparatus comprising:

a recording apparatus fitting portion to be fitted in said recording apparatus via means provided on said recording apparatus fitting portion which fit with corresponding means provided on said recording apparatus thereby defining a position of said recording apparatus; and a packaging member covering a circumference of said contained recording sheet;

wherein said recording apparatus fitting portion includes a limiting surface for limiting movement of said contained recording sheet in an extracting direction by contacting a leading end of said contained recording sheet, and recording sheet rear end pressing means which applies an elastic force to said contained recording sheet in the extracting direction toward said limiting surface, and wherein said packaging member is exposed when said recording apparatus fitting portion is fitted in said recording apparatus.

18. A recording sheet containing package for containing a recording sheet for use in a recording apparatus comprising:

a recording apparatus fitting portion to be fitted in said recording apparatus via means provided on said recording apparatus fitting portion which fit with corresponding means provided on said recording apparatus thereby defining a position of said recording apparatus; and a packaging member covering a circumference of said contained recording sheet;

wherein said recording apparatus fitting portion includes a lateral end position limiting member for limiting an end position of said contained recording sheet transverse to an extracting direction, and biasing means which extends along a lateral edge opposite to said lateral end position limiting member and applies an elastic force to said recording sheet in a direction toward said lateral end position limiting member;

wherein said recording apparatus fitting portion includes a front wall for limiting movement of said contained recording sheet in the extracting direction by contacting a leading end of said contained recording sheet in the extracting direction;

wherein said recording apparatus fitting portion includes a recording sheet rear end pressing means which extends along a rear edge of said contained recording sheet in the extracting direction thereof and applies an elastic force to said contained recording sheet in the extracting direction so that a front end of said contained recording sheet abuts said front wall; and wherein said packaging member is exposed when said recording apparatus fitting portion is fitted in said recording apparatus.

19. A recording apparatus comprising:

a recording sheet containing package according to any one of claims 1, 2, 17 and 18;

feeding means which feeds a recording sheet contained in said recording sheet containing package; and recording means which executes recording on the recording sheet fed by said feeding means.

20. The recording apparatus according to claim 19, wherein said recording means includes an ink sheet, and a thermal head for transferring an ink, coated on said ink sheet, to the recording sheet.

* * * * *

UNITED STATES PATENT AND TRADEMARK OFFICE

CERTIFICATE OF CORRECTION

PATENT NO. : 7,163,286 B2
APPLICATION NO. : 10/892087
DATED : January 16, 2007
INVENTOR(S) : Yoshinobu Shiraiwa et al.

It is certified that error appears in the above-identified patent and that said Letters Patent is hereby corrected as shown below:

ON THE TITLE PAGE ITEM -56- REFERENCES CITED:

Foreign Patent Documents, "JP 2005092914 A * 4/2005" should read --JP 2005-092914 A * 4/2005--.

COLUMN 2:

Line 49, "on" should read --of--.

COLUMN 3:

Line 14, "sheet-" should read --sheet--.

COLUMN 4:

Line 25, "garbage," should read --garbage, and--; and
Line 65, "compact" should read --compact,--.

COLUMN 5:

Line 52, "packing" should read --package--.

COLUMN 6:

Line 30, "8 etc." should read --8, etc.,-- and "head 18" should read --head 18,--.

COLUMN 7:

Line 22, "substantially" should read --substantially the--.

COLUMN 9:

Line 59, "read" should read --rear--.

COLUMN 13:

Line 28, "members," should read --member,--.

UNITED STATES PATENT AND TRADEMARK OFFICE

CERTIFICATE OF CORRECTION

PATENT NO. : 7,163,286 B2
APPLICATION NO. : 10/892087
DATED : January 16, 2007
INVENTOR(S) : Yoshinobu Shiraiwa et al.

It is certified that error appears in the above-identified patent and that said Letters Patent is hereby corrected as shown below:

COLUMN 16:

Line 18, "sheet," should read --sheet--.

Signed and Sealed this

Third Day of July, 2007

JON W. DUDAS
*Director of the United States Patent and Trademark Office*